US008235741B2

(12) United States Patent
Schulze et al.

(10) Patent No.: US 8,235,741 B2
(45) Date of Patent: Aug. 7, 2012

(54) ELECTRIC PLUG CONNECTOR HAVING A SEALING ELEMENT

(75) Inventors: Mario Schulze, Wegberg (DE); Nico Walther, Wuerselen (DE)

(73) Assignee: Escha Bauelemente GmbH, Halver (DE)

( * ) Notice: Subject to any disclaimer, the term of this patent is extended or adjusted under 35 U.S.C. 154(b) by 460 days.

(21) Appl. No.: 12/601,953

(22) PCT Filed: Mar. 31, 2008

(86) PCT No.: PCT/EP2008/053789

§ 371 (c)(1),
(2), (4) Date: Nov. 25, 2009

(87) PCT Pub. No.: WO2008/145435

PCT Pub. Date: Dec. 4, 2008

(65) Prior Publication Data

US 2010/0136817 A1 Jun. 3, 2010

(30) Foreign Application Priority Data

May 29, 2007 (DE) ..... 10 2007 024 856
Feb. 1, 2008 (DE) ..... 10 2008 007 257

(51) Int. Cl.
*H01R 13/622* (2006.01)

(52) U.S. Cl. ..... 439/339

(58) Field of Classification Search ..... 439/339, 439/321, 320, 317, 350, 352, 256, 271; 285/362
See application file for complete search history.

(56) References Cited

U.S. PATENT DOCUMENTS

| | | | | |
|---|---|---|---|---|
| 5,192,219 | A * | 3/1993 | Fowler et al. | 439/321 |
| 5,376,015 | A * | 12/1994 | Fuchs et al. | 439/321 |
| 5,971,787 | A * | 10/1999 | Brown | 439/321 |
| 6,247,956 | B1 * | 6/2001 | Porter, Jr. | 439/352 |
| 6,267,612 | B1 * | 7/2001 | Arcykiewicz et al. | 439/253 |
| 6,733,337 | B2 * | 5/2004 | Kodaira | 439/578 |
| 6,769,926 | B1 * | 8/2004 | Montena | 439/253 |
| 7,364,450 | B2 * | 4/2008 | Hafner et al. | 439/255 |
| 7,366,450 | B2 * | 4/2008 | Suzuki | 399/254 |
| 7,413,457 | B2 * | 8/2008 | Mehnert et al. | 439/321 |
| 7,467,978 | B2 * | 12/2008 | Sundermeier | 439/690 |
| 7,484,988 | B2 * | 2/2009 | Ma et al. | 439/350 |
| 7,503,788 | B2 * | 3/2009 | Holterhoff et al. | 439/256 |
| 7,878,832 | B2 * | 2/2011 | Hui | 439/271 |
| 7,918,677 | B2 * | 4/2011 | Robert | 439/317 |
| 7,984,933 | B2 * | 7/2011 | Helstern | 285/362 |
| 2007/0145744 | A1 * | 6/2007 | Mehnert et al. | 285/333 |
| 2012/0058659 | A1 * | 3/2012 | Mehnert et al. | 439/271 |

FOREIGN PATENT DOCUMENTS

| | | |
|---|---|---|
| DE | 196 13 228 | 10/1997 |
| DE | 198 36 137 A | 3/2000 |
| DE | 10 2004 028 060 | 1/2006 |
| DE | 10 2005 056 563 | 3/2007 |
| EP | 1 626 463 A | 2/2006 |

* cited by examiner

*Primary Examiner* — Alexander Gilman
(74) *Attorney, Agent, or Firm* — Lucas & Mercanti, LLP; Klaus P. Stoffel

(57) ABSTRACT

The invention relates to an electric plug-in connector having a contact carrier (1) and a threaded part (2), which can be screwed together with a counter-threaded part (4) of a counter plug connector in a configuration as a cap nut or cap screw, wherein an elastic sealing element (5) is pressed together, wherein an actuation sleeve (6) is associated with the threaded part (2), to which a torque can be applied, and which is pivot-coupled to the threaded part (2). In order to avoid damage to the sealing element, the invention provides an elastic active element (7, 30, 34) that deforms during the pressing together of the sealing element (5) such that the pivot coupling is released between the actuation sleeve (6) and the threaded part (2) upon exceeding a threshold deformation

27 Claims, 11 Drawing Sheets

ELECTRIC PLUG CONNECTOR HAVING A SEALING ELEMENT

This application is a 371 of PCT/EP2008/053789 filed Mar. 31, 2008, which in turn claims the priority of DE 10 2007 024 856.5 filed May 29, 2007 and DE 10 2008 007 257.5 filed Feb. 1, 2008, the priority of these applications is hereby claimed and these applications are incorporated by reference herein.

The invention pertains to an electric plug connector with a contact carrier and a threaded part, which, in a design as a cap nut or cap screw, can be screwed to a mating threaded part of a mating plug connector, wherein an elastic sealing element is compressed, and wherein an actuating sleeve, to which a torque can be applied and which is connected to the threaded part for rotation in common, is assigned to the threaded part.

An electric plug connector of this type is already known from DE 10 2004 028 060 A1. In that document, a plug element of an electric plug type connection is described, in which the threaded part is designed as a cap nut or cap screw. The threaded part is formed by spring tongues, which comprise radially inward-projecting threaded sections. These threaded sections can be inserted into the threads of a mating threaded part. So that torque can be exerted on these spring tongues, which form the threaded part, an actuating sleeve is provided, which is connected for rotation in common to the spring tongues forming the threaded part. A sealing element, formed by a rubber O-ring, lies on a shoulder of a contact carrier. The end-face boundary edge of a cup-shaped insertion opening for the contact carrier is pressed against this sealing element, so that the electrical plug connection can be made essentially water-tight.

An electrical plug connector in which the threaded part can be designed either as a cap nut or as a cap screw is also known from DE 196 13 228 B4. Here, too, an O-ring, which is compressed when the plug connector and the opposing plug connector are screwed together, rests on a shoulder formed on the contact carrier.

DE 10 2005 056 563 B3 deals with the problem that a sealing element formed by an O-ring may be compressed only to a certain permissible degree, so that it is not damaged when the plug connector is connected to the mating plug connector. In the case of the solution described here, the boundary edge of an insertion opening formed by the mating plug connector comes up against a shoulder, which limits the degree to which the mating threaded part can be displaced when the threaded part and the mating part are screwed together.

SUMMARY OF THE INVENTION

The invention is based on the goal of improving a plug element of the general type in question in a manner advantageous to its use and in particular on the goal of providing measures by which damage to the sealing element can be avoided.

The goal is achieved by the invention described in the claims, wherein each claim represents in principle an independent solution to the problem and can be combined with another claim.

First and most importantly, an elastic working element is provided. When the sealing element is compressed, this working element becomes deformed, and when the degree of deformation of the elastic working element exceeds a certain limit, the rotational connection between the actuating sleeve and the threaded part becomes disengaged. During the initial phase of screwing the plug connector to its mating plug connector, the actuating sleeve is in rotational connection with the threaded part. This means that, when the actuating sleeve is turned, the threaded part turns also. The threaded part can be screwed initially into the mating threaded part of a mating plug connector until the end-face boundary edge of an opening for the insertion of the contact carrier of the plug connector starts to act on the sealing element. When the actuating sleeve is turned further, the threaded part continues to be carried along with it. Because of the resistance which the sealing element exerts on the mating threaded part, the elastic working element becomes increasingly deformed as the turning continues. The axial force thus exerted on the threaded part is transmitted to the mating threaded part, with the result that force is exerted on the sealing element in the axial direction and the sealing element is therefore deformed. As the actuating sleeve continues to be turned, the tensioning force and thus also the deformation of the sealing element increase. The rotational connection between the actuating sleeve and the threaded part becomes disengaged when the threaded part has shifted position with respect to the actuating sleeve by a certain amount. The elastic working element, which has been put under tension as part of this axial displacement, compresses the elastic sealing element by a certain amount, so that the rotational connection between the actuating sleeve and the threaded part is disengaged when the degree to which the elastic sealing element has been compressed has reached a predetermined value, which depends essentially on the elastic properties of the working element and of the sealing element and also of a rotational connection, to be described more fully further below, between the actuating sleeve and the threaded part. After the rotational connection has been disengaged, the actuating sleeve can continue to be turned without carrying the threaded part along with it. So that the threaded part can be separated from the mating threaded part, however, it is possible to restore the rotational connection. In a first variant of the invention, it is provided that the rotational connection becomes disengaged when the degree to which the sealing element is compressed exceeds a predetermined value. It is preferable here for the threaded part to be displaceable in the direction toward the mating plug connector against the elastic restoring force of the working element. It can be displaced with respect to the contact carrier, but it should also be displaceable with respect to the actuating sleeve. When the degree of displacement exceeds a certain limit, a positive connection for rotation in common between the actuating sleeve and the threaded part should become disengaged. The elastic working element can be a compression spring. It can also be a wave washer, however. When the threaded part is screwed together with the mating threaded part, this rotational connection, which is normally present, becomes disengaged. This is accomplished by the axial displacement of the threaded part versus the actuating sleeve. The actuating sleeve can in particular be axially displaced relative to the contact carrier or the threaded part against the restoring force of a spring element to restore the rotational connection, especially the positive connection for rotation in common, after the threaded part has been brought into proper engagement with the mating threaded part under compression of the sealing element. The positive connection for rotation in common can be formed by meshing teeth. For this purpose, the threaded part and the actuating sleeve can form sets of radial teeth, which engage with each other when the plug connector is in its base position. When the threaded part is screwed together with the mating threaded part of a mating connector, the threaded part shifts its position on the mating threaded part until contact has been made with the sealing element. When, by the application of torque to the actuating sleeve, the threaded part is turned even farther, the sealing element is compressed. As a result of the accompanying simultaneous compression of the elastic working element, which otherwise holds the threaded part axially in position with respect to the contact carrier, the threaded part shifts position toward the mating threaded part, wherein the elastic working part is compressed. During this axial displacement of the threaded part, which also occurs with respect to the actuating sleeve, the positive connection for rotation in common is disengaged as soon as the degree of displacement exceeds a certain limit. To restore the positive connection for rotation in common, the actuating sleeve can be displaced in the axial direction with respect to the threaded part. For this purpose, the actuating sleeve is preferably also spring-loaded by wave washer. The stiffness of the elastic working element is selected so that it is possible for the sealing element, which is formed in particular by an O-ring, can be deformed as required. The O-ring is preferably supported against an annular collar on the contact carrier. The threaded part preferably comprises an internal thread, and certain areas of it are surrounded by the actuating sleeve. The elastic working element, which is preferably a wave washer, can be supported on the rear surface of the annular collar. It then lies between the shoulder formed by the rear surface of the internal thread and a support surface on the threaded part. The wave washer, which spring-loads the actuating sleeve, can comprise a smaller diameter than the wave washer which forms the elastic working element. This spring element formed by a smaller wave washer can also be supported in particular on a shoulder of the contact carrier by way of a flat washer. In a preferred embodiment, which is of independent status, the threaded part can be assembled from two separate pieces. A first piece forms a toothed part . It carries a set of radial teeth and can be connected to a second piece, which forms the thread. The set of radial teeth in the area of the bottom of the cavity of the actuating sleeve has axially oriented tooth flanks. This set of internal teeth engages in the corresponding set of external teeth on the threaded part. Here, too, the teeth extend in the axial direction, so that, when the tooth flanks are resting against each other, the forces which occur during the application of torque act in a direction normal to the surface of the tooth flanks. When torque is being transmitted from the actuating sleeve to the threaded part, there is preferably no axial component present to act on the threaded part.

In a variant of the invention, which also comprises independent status, it is provided that the rotational connection between the threaded part and the actuating sleeve becomes disengaged when the torque exceeds a certain limit. In the case of this solution, driver lobes which have a sawtooth design can be provided. These driver lobes have sloping flanks. Driver elements, upon which the elastic working element acts, rest against these sloping flanks. When the torque exceeds the limit value, the driver elements slide over the driver lobes. The driver elements can be formed by the ends of spring tongues, wherein the spring tongues then form the elastic working element. The spring tongues can be formed by an annular spring element, which is surrounded radially on the outside by the actuating sleeve and radially on the inside by the threaded part. This annular spring element can form windows, out of which the leaf spring-like spring tongues are cut. The spring tongues can thus deflect in the radial direction and, when the torque exceeds the limit value, slide over the sloping flanks. In the opposite direction, i.e., in the loosening direction of the thread, the ends of the spring tongues lie in front of steep flanks of the driver lobes, which means that higher torques can be applied in this direction of rotation. The driver lobes are preferably assigned to the threaded part. The annular spring element is then preferably connected nonrotatably to the actuating sleeve. The actuating sleeve and the threaded part are assigned in an essentially axially immovable manner with respect to the contact carrier. They can, however, rotate with respect to the contact carrier, so that the threaded part can be screwed to the mating threaded part.

In another variant of the invention, the driver elements which work together with the driver lobes also comprise a sawtooth shape. The sawtooth elements and the sawtooth lobes can engage in each other. They can engage in each other in such a way that the sloping flanks rest against each other. When in contact position, the driver elements are pressed by the elastic working element toward the driver lobes. The actuating sleeve in this embodiment can preferably be displaceable in the axial direction with respect to the threaded part, wherein the elastic working element is put under tension during such displacement. In this exemplary embodiment, the elastic working element preferably has the shape of a compression spring element and holds the axially intermeshing teeth of the driver elements and the driver lobes in engagement. When the degree of displacement reaches a certain limit value, the driver elements slide over the driver lobes.

In another variant of the invention, the rotational connection between the threaded part and the actuating sleeve, i.e., the connection which can be released when the torque exceeds a certain limit value, is formed by latching springs. The latching springs can be assigned either to the threaded part or to the actuating sleeve. They form a latching connection with the latching niches formed in the other part. The latching springs are preferably held by a sleeve piece of the threaded part. For this purpose, this sleeve piece forms support recesses. The support recesses are assigned to the outside lateral surface of this sleeve piece and form slots with undercut edges. The latching springs are designed as leaf springs, and their terminal sections, which are bent over to form a V-like shape, lie in these undercuts. The middle area projects radially away from the sleeve piece and forms a rounded crest, which lies in a latching niche in the actuating sleeve when the parts are connected for rotation in common. On its inside lateral surface, the actuating sleeve has a plurality of rounded latching niches, which form a wave-like structure overall. When the torque exceeds the limit value, the leaf springs can move out of the latching niches in the radially inward direction. The ends of the leaf springs therefore lie with a certain play in the undercuts of the bearing recesses. Overall, three latching springs are provided, which are distributed uniformly around the circumference. To ensure that torques which are higher than the limit torque can be transmitted from the actuating sleeve to the threaded part in the loosening direction, a freewheel locking mechanism is provided in one variant of the invention. The locking mechanism acts like a ratchet mechanism. Locking springs are provided, which engage in engagement niches. The locking springs can be assigned either to the actuating sleeve or to the threaded part. The engagement niches, which form locking shoulders, are then assigned to the other part. The locking springs are preferably formed out of the material of the sleeve piece, fabricated of plastic, of the threaded part. The locking springs form elastic, radially projecting tongues, which engage in the engagement niches in such a way that the ends of the tongues push against locking shoulders in the loosening direction, so that in this way torque can be transmitted from the actuating sleeve to the threaded part. The locking mechanism and the rotational connection preferably lie in different axial planes, wherein the two axial planes are, however, adjacent to each other. When the torque exceeds the limit value while the two plug parts are being screwed together, the locking springs slide over the locking shoulders in the opposite direction.

BRIEF DESCRIPTION OF THE DRAWINGS

Exemplary embodiments of the invention are explained below on the basis of the attached figures.

DETAILED DESCRIPTION OF THE INVENTION

Figure 1:
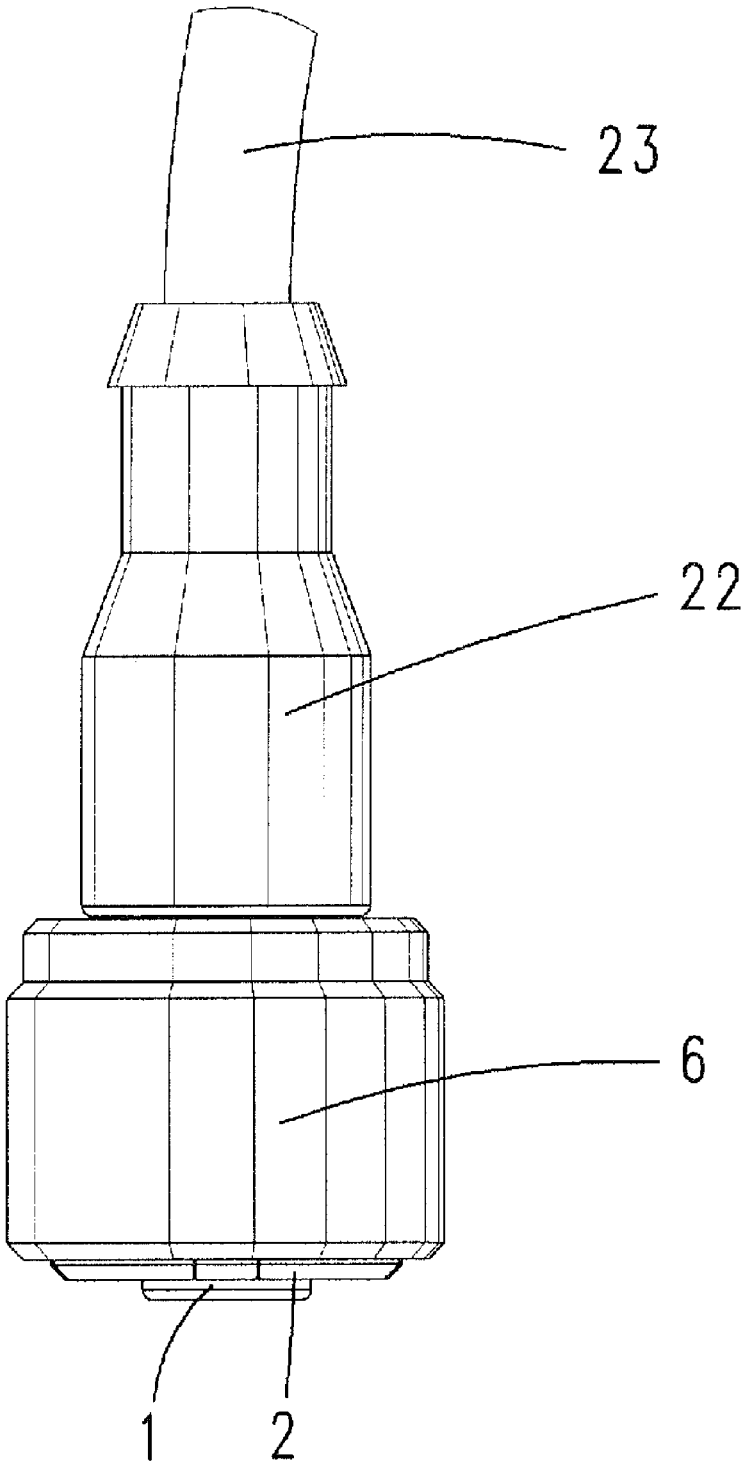
FIG. 1 shows a side view of a first exemplary embodiment.

FIG. 1 shows a side view of an electric plug connector, which can be plugged into a mating electric plug connector. The electric plug connector is seated on a cable 23. The end of the cable 23 is surrounded by a layer of injection-molded plastic 22. The injection-molded plastic layer 22 surrounds not only a partial area of a contact carrier 1 consisting of a harder plastic but also parts of the wires arranged inside the cable sheath. These wires are connected to contact elements (not shown), which are assigned to the contact carrier 1 and which, in the plugged-in state, are in electrically conductive contact with the contact elements of the mating plug.

An actuating sleeve 6, which can be turned by hand or by a tool, is seated on the contact carrier 1.

Figure 2:
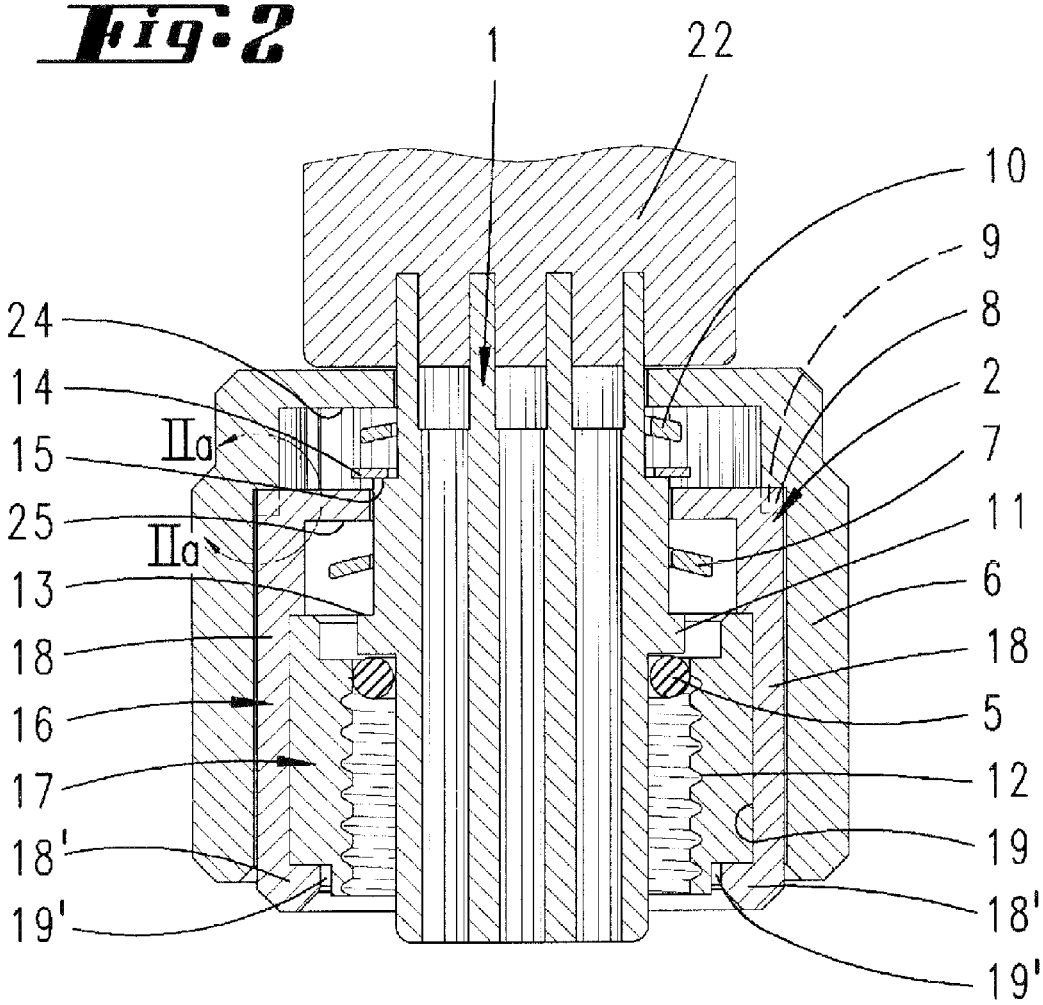
FIG. 2 shows an enlarged longitudinal cross section through the actuating sleeve, the threaded part, and the contact carrier of the exemplary embodiment according to FIG. 1 in a base position.
Figure 2A:
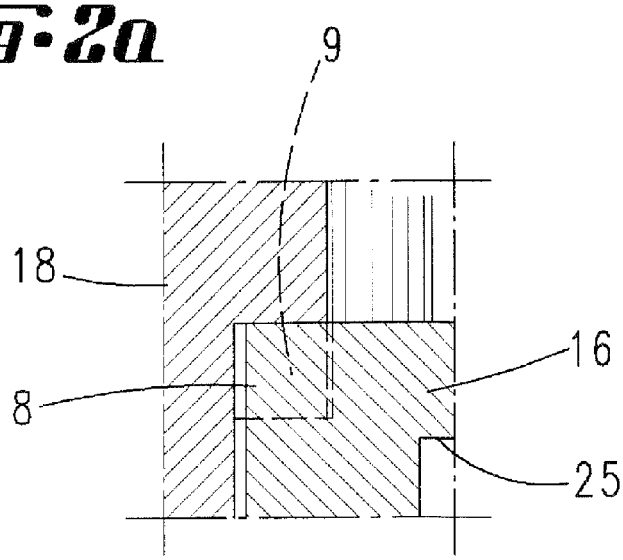
FIG. 2*a* shows a magnified view of the area marked by line IIa-IIa in FIG. 2.
Figure 5:
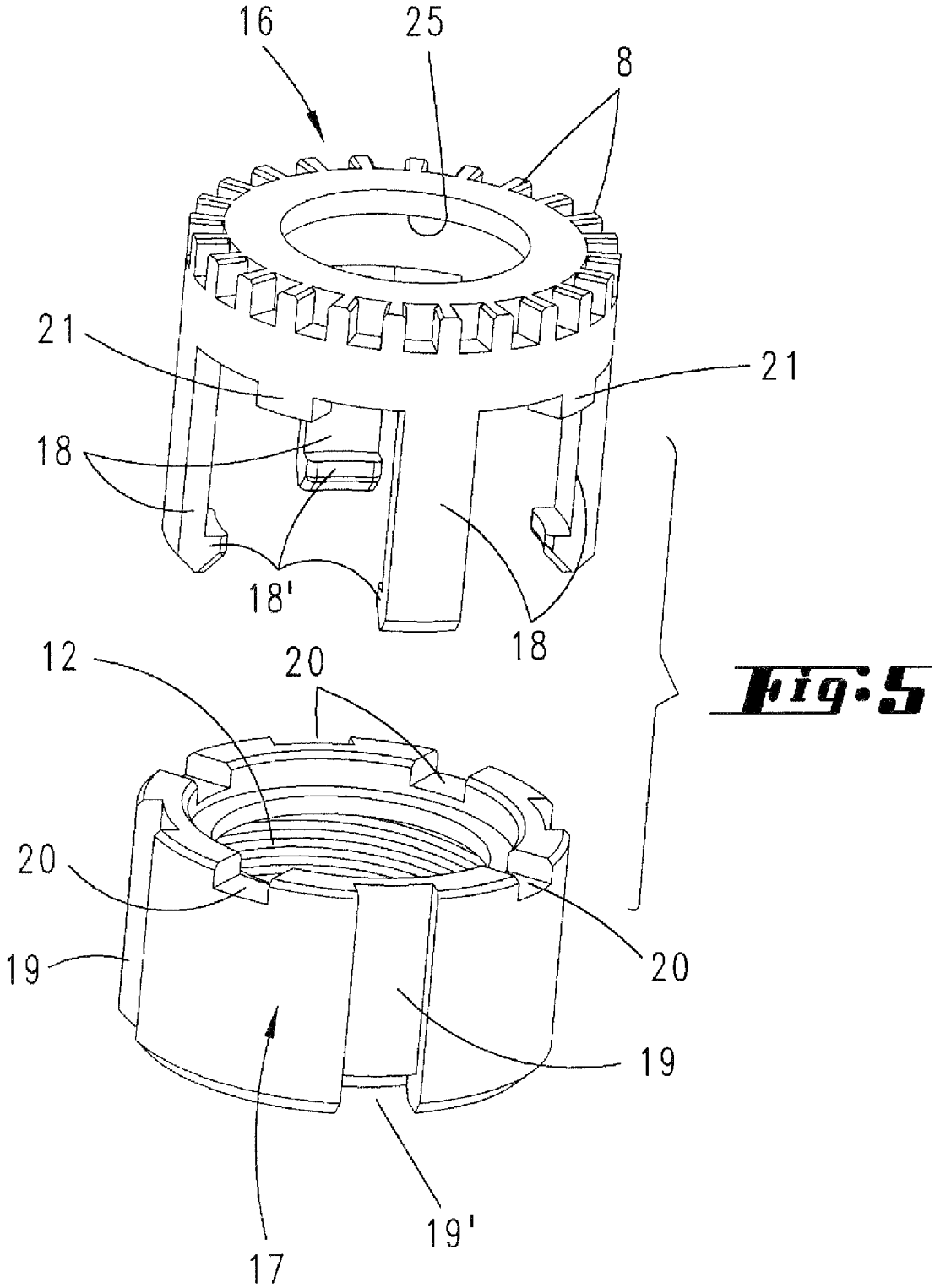
FIG. 5 shows a three-dimensional, exploded diagram of the two pieces forming the threaded part 2.
Figure 6:
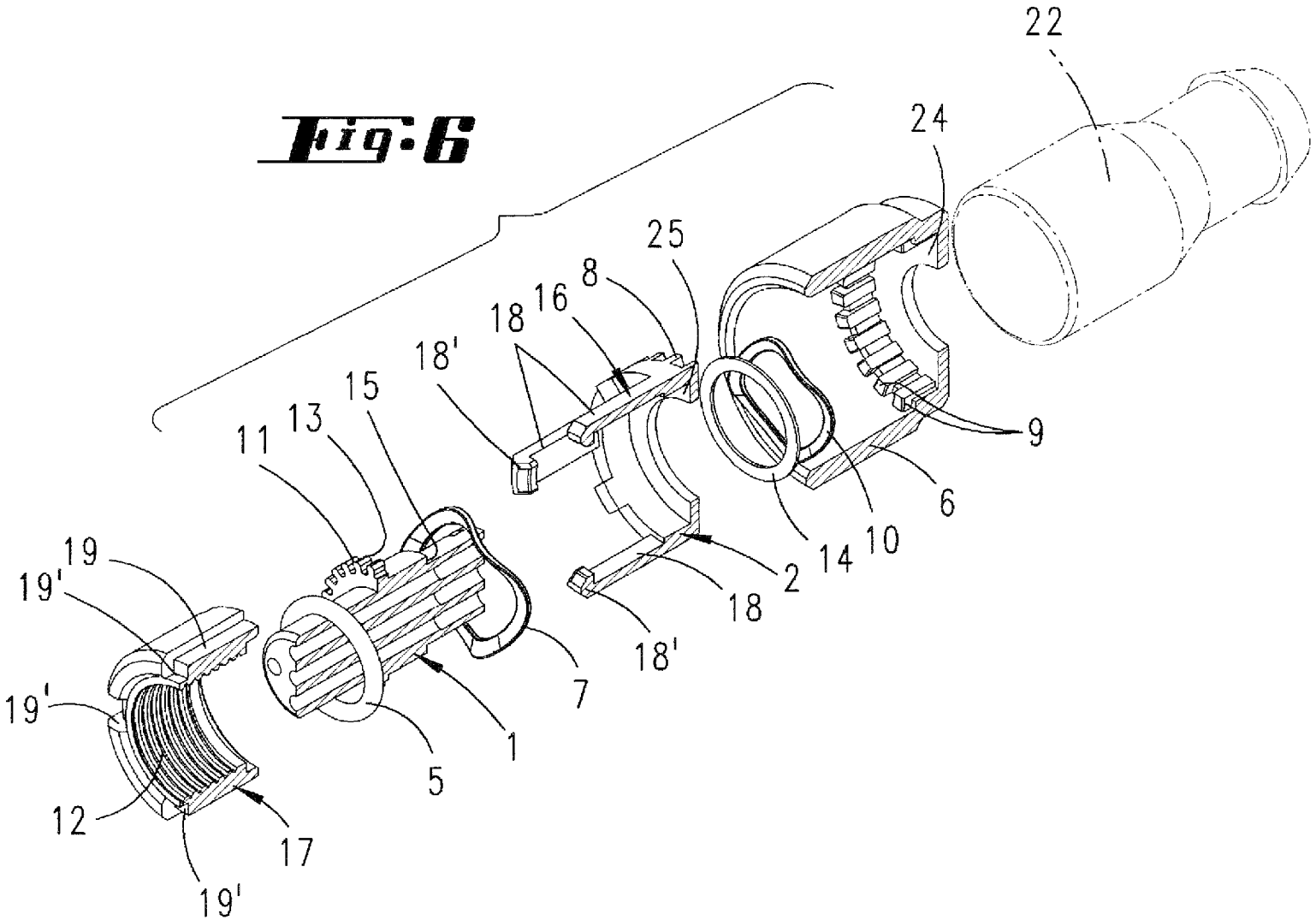
FIG. 6 shows an exploded diagram of all the parts of the plug connector.

The actuating sleeve 6 encapsulates in its interior a threaded part 2. The threaded part 2, as can be seen especially clearly in FIGS. 5 and 6, is made up of two pieces. It has a threaded piece 17, which consists of plastic and which forms an internal thread 12. This sleeve-like threaded piece 17 can be clipped to a toothed piece 16. The clipping-together is axial and nonrotatable. To accomplish this, hook arms 18 of the toothed piece 16 fit into engagement recesses 19 in such a way that the hook ends 18 latch in the pockets 19' of the engagement recesses 19. In the assembled state, as can be seen especially in FIG. 2, a wave washer 7, which forms the previously described elastic working element, lies inside the cavity between a support surface 25 of the toothed piece 16 and the end-face boundary edge of the threaded piece 17.

The wave washer 7 is supported under a certain pretension on a rear-facing shoulder 13 of an annular collar 11 on the contact carrier 1.

Figure 3:
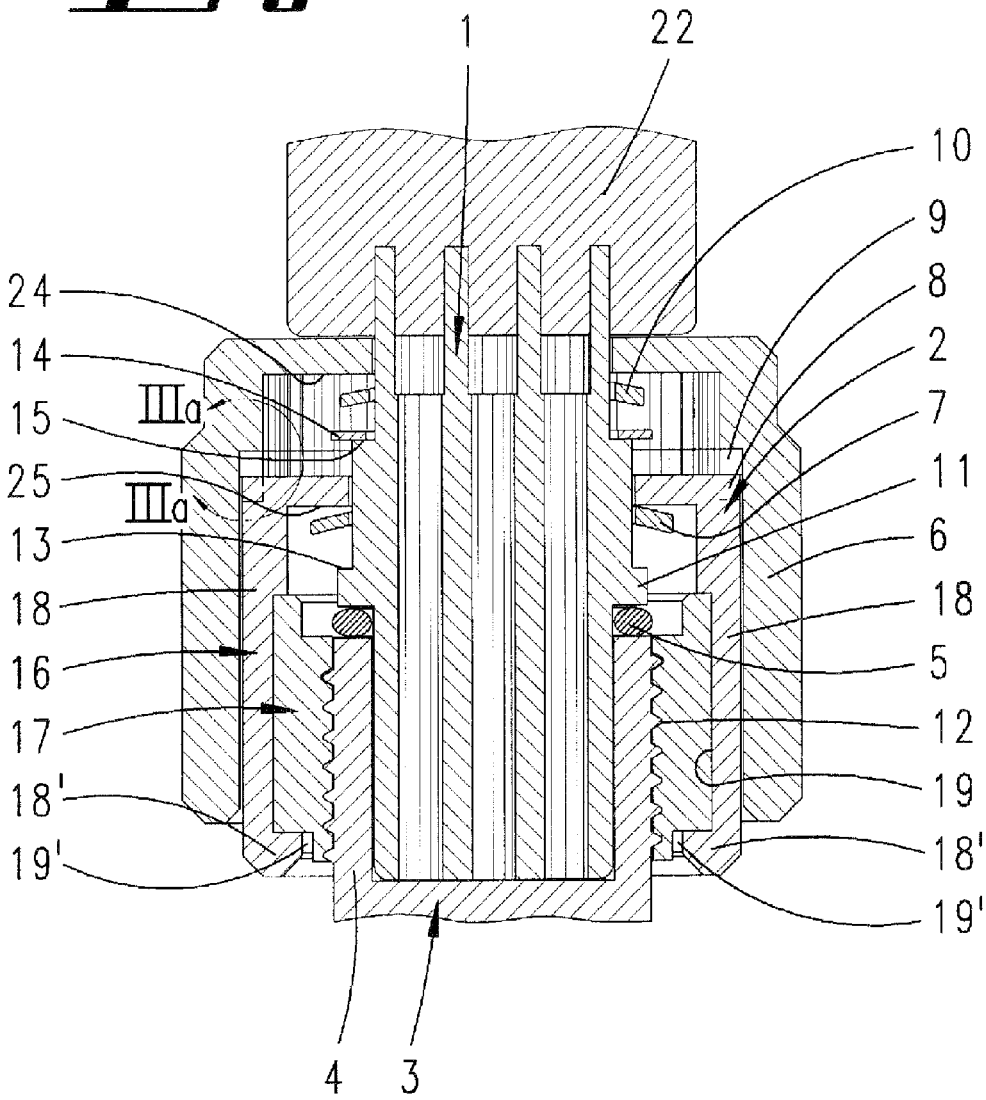
FIG. 3 shows a diagram similar to FIG. 2 with a screwed-in mating threaded part, wherein the threaded part 2 is disengaged from the actuating sleeve 6.

On its other side, i.e., the side facing the mating plug, the annular collar 11 has another shoulder. An O-ring 9, made of rubber, which forms a sealing element, is seated on this shoulder. The internal thread 12 of the threaded part 2 surrounds a cylindrical gap around the contact carrier 1, which—as shown in FIG. 3—can be inserted into an insertion opening in a mating plug connector 3.

The outside wall of the insertion opening of the mating plug connector 3 forms a mating threaded part 4 with an external thread, onto which the internal thread 12 of the threaded part 2 can be screwed in such a way that the end-face boundary edge of the mating threaded part 2 acts on the O-ring 5.

The end surface of the threaded part 2 facing the cable 23, i.e., the surface formed by the toothed piece 16, forms a set of radial teeth 8, with tooth flanks which rise steeply in the axial direction. The actuating sleeve 6 forms a set of matching teeth 9, corresponding to the set of radial teeth 8. This set of radial teeth 9 is located in the interior of the actuating sleeve 6 and is situated there directly adjacent to a support surface 24 for a smaller wave washer 10, which for its own part is supported on one side under pretension against the support surface 24 and on the other side against a flat washer 14. The flat washer 14 lies on a shoulder 15 of the contact carrier 1. The wave washer 7 and the wave washer 10 are encapsulated inside the threaded part 2 and/or inside the actuating sleeve 6 surrounding the threaded part 2.

The threaded part 2 can be moved toward the free end of the contact carrier 1, away from the cable 23, under compression of the wave washer 7, which is under a certain amount of pretension in the axial direction. As this is happening, the set of radial teeth 8 slides along the set of radial teeth 9. The threaded part 2 can be shifted so far in the axial direction relative to the actuating sleeve 6 that the set of radial teeth 8 escapes from the set of radial teeth 9. The two sets of radial teeth 8, 9 form a positive connection for rotation in common, which becomes disengaged after a corresponding displacement of the threaded part 2 relative to the actuating sleeve 6 but which can be restored by an axial displacement of the actuating sleeve 6 against the force of the wave washer 10, i.e., a displacement such that the set of radial teeth 9 is brought back into engagement with the set of radial teeth 8.

In the exemplary embodiment, the compression spring element 10 is designed as a wave washer. It can also be formed, however, by a helical compression spring. In a corresponding manner, the larger wave washer 7 can also be replaced by a appropriately designed helical compression spring.

Figure 3A:
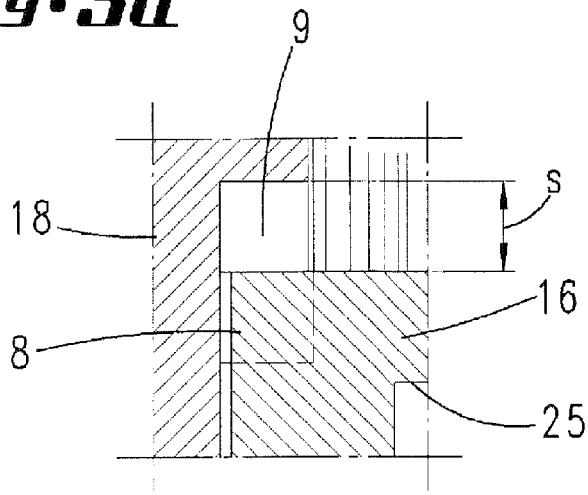
FIG. 3*a* shows a magnified view of the area marked by line IIa-IIa in FIG. 3.

The electric plug connector functions as follows: Starting from the base position shown in FIG. 2, the threaded part 2 is screwed onto a mating threaded part 4 by turning the actuating sleeve 6 until the end-face boundary edge of the mating threaded part 4 starts to exert pressure on the O-ring 5. When this position is reached, additional turning of the actuating sleeve 6 causes the threaded part 2 to continue to rotate also, but as a result of the axial resistance which the O-ring 5, as it is being compressed, offers to the threaded part 2, the threaded part 2 shifts its position in the direction toward the mating plug connector 3 as the two components continue to be screwed together. This is accompanied by a simultaneous increase in the tension of the wave washer 7 and by an axial displacement of the threaded part 2 with respect to the actuating sleeve 6. The rotation in common continues until the displacement reaches a certain limit, at which the wave washer 7 has arrived in a final state of tension, which supplies the compressive force by which the O-ring 5 is compressed. This limit displacement is shown in FIGS. 3 and 3*a* and is designated by the letter "S" in FIG. 3*a*. In this position, the threaded part 2 can lie just short of a stop position on the contact carrier 1 but does not actually reach it. In this position, the set of radial teeth 8 of the threaded part 2 has escaped completely from the mating set of teeth 9 of the actuating sleeve 6, so that the above-mentioned positive connection for rotation in common is now disengaged.

Figure 4:
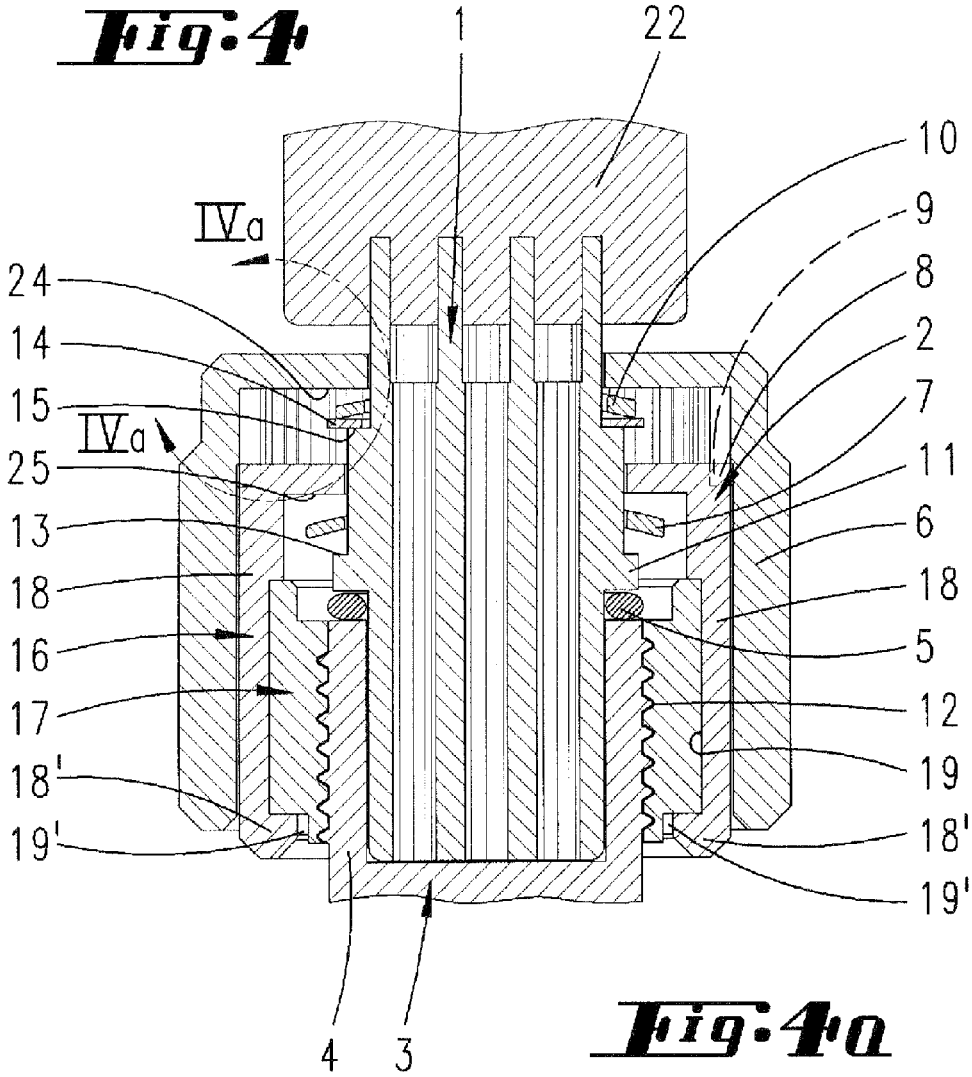
FIG. 4 shows a diagram similar to FIG. 4, wherein, as a result of the axial displacement of the actuating sleeve 6, the positive connection for rotation in common between the actuating sleeve 6 and the threaded part 2 has been restored.
Figure 4A:
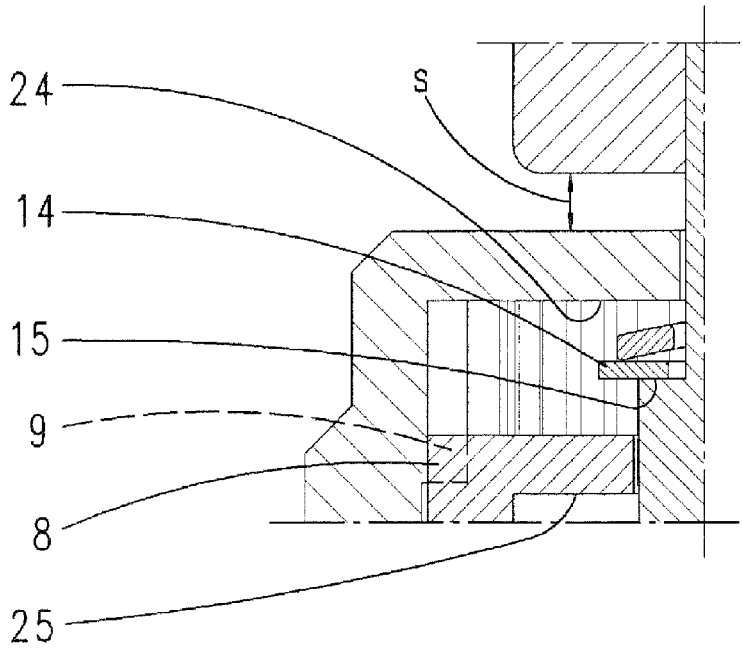
FIG. 4*a* shows a magnified view of the area marked by line IVa-IVa in FIG. 4.

When the plug connector is to be disconnected from the mating plug connector, simply turning the actuating sleeve 6 back in the opposite direction is not enough. Instead, the actuating sleeve 6 must first be moved slightly in the axial direction against the restoring force of the wave washer 10 until the set of radial teeth 9 engages again in the set of radial teeth 8 and a positive connection for rotation in common is thus established (see FIG. 4 and FIG. 4*a*). In FIG. 4*a*, "S" designates the distance by which the actuating sleeve 6 must be moved with respect to the threaded part 2 so that the set of teeth 9 can engage in the set of teeth 8. The threaded part 2 can now be carried along in the loosening direction until it has shifted position so far in the axial direction with respect to the contact carrier 1 that the sets of radial teeth 8, 9 engage with each other even without any compression of the compression spring 10 or any axial displacement of the actuating sleeve 6.

Figure 7:
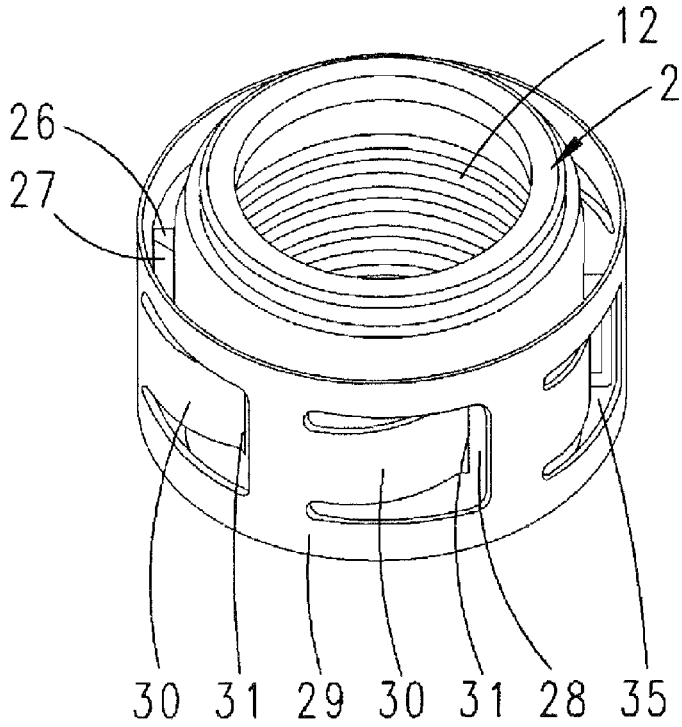
FIG. 7 shows a perspective view of part of a second exemplary embodiment of the invention.
Figure 8:
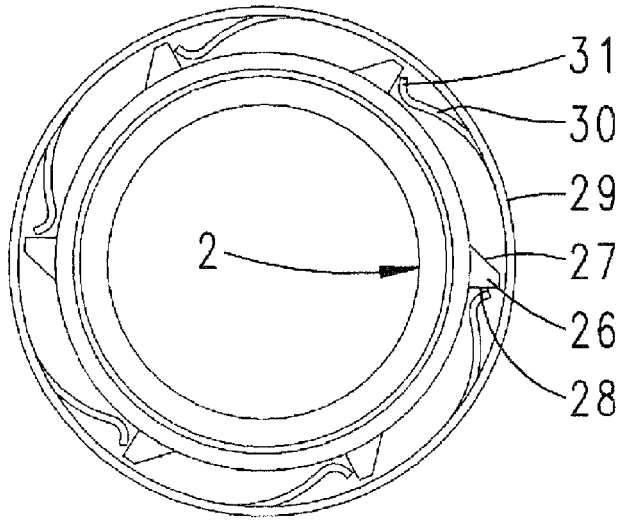
FIG. 8 shows an axial view of the part according to FIG. 7.

The two other exemplary embodiments, shown in FIGS. 7-10, also comprise an actuating sleeve and a threaded part, which is separate from the sleeve but connected to it for rotation in common. Only the essential elements are illustrated in the drawings, however. FIGS. 7 and 8 show only an area of the threaded part 2 and an annular spring 29, surrounding the threaded part 2.

In the case of the second exemplary embodiment, the threaded part 2 has, on its outside lateral cylindrical surface, radially projecting driver lobes 26. Each of these driver lobes 26, which are distributed uniformly around the circumference, has a sloping flank 27 on one side and a steep flank 28 on the other side. Between the actuating sleeve 6 and the threaded part 2, there is an annular spring 29, which is made of spring steel. Spring tongues 30 are cut out from the circumferential surface of the annular spring 29, as a result of which windows 35 are formed. These spring tongues project radially inward. The free ends 31 of the spring tongues 30 form driver elements. They are rounded for this purpose. The annular spring 29 is connected nonrotatably to the actuating sleeve 6.

When the actuating sleeve 6 is turned in the rotational direction of the internal thread 12, the threaded part 2 can be screwed onto the mating threaded part of a mating plug connector, so that the end-face boundary edge of the mating threaded part exerts force on the O-ring 5, which is also provided in this second exemplary embodiment. Once a certain contact force is reached, the driver elements formed by the ends of the spring tongues, which otherwise lie in front of the sloping flanks 27, slide over the driver lobes, which means that it is possible to tighten the threaded part 2 only up to a certain limiting torque value.

When the plug connection is to be disconnected, the actuating sleeve 6 must be turned in the opposite direction. Then the driver elements 31, which are formed by the ends of the spring tongues 30, are supported against the steep flanks 28 of the driver lobes 26, which makes it possible to exert stronger loosening torques.

Figure 9:
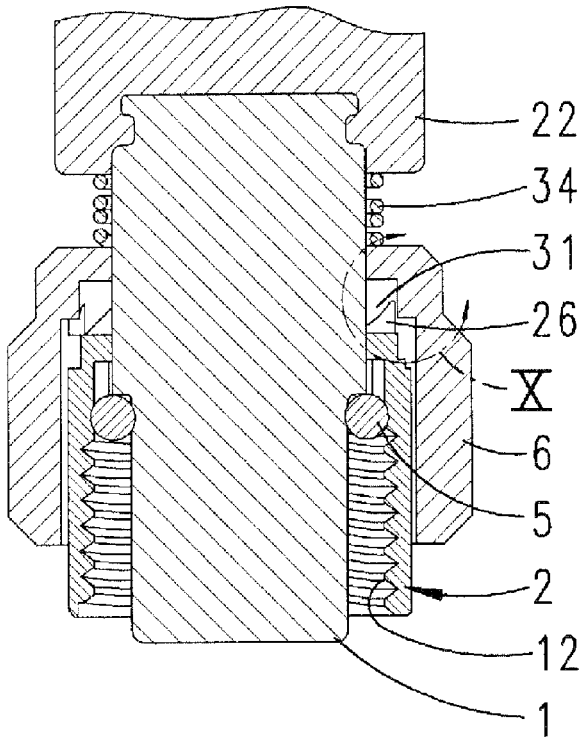
FIG. 9 shows a cross-sectional view similar to FIG. 2 of a third exemplary embodiment.
Figure 10:
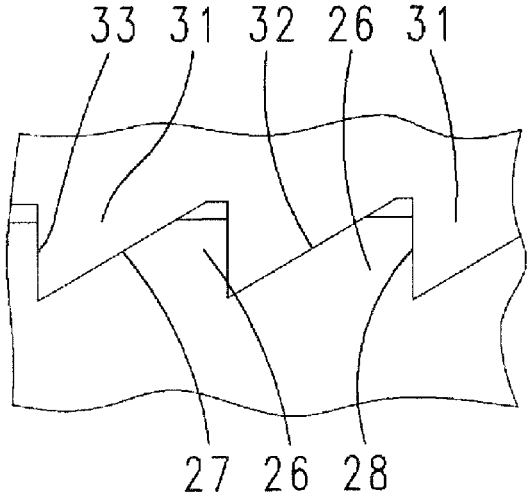
FIG. 10 shows the engagement between the teeth of the actuating sleeve 6 and the teeth of the threaded part 2 in a small area.
Figure 11:
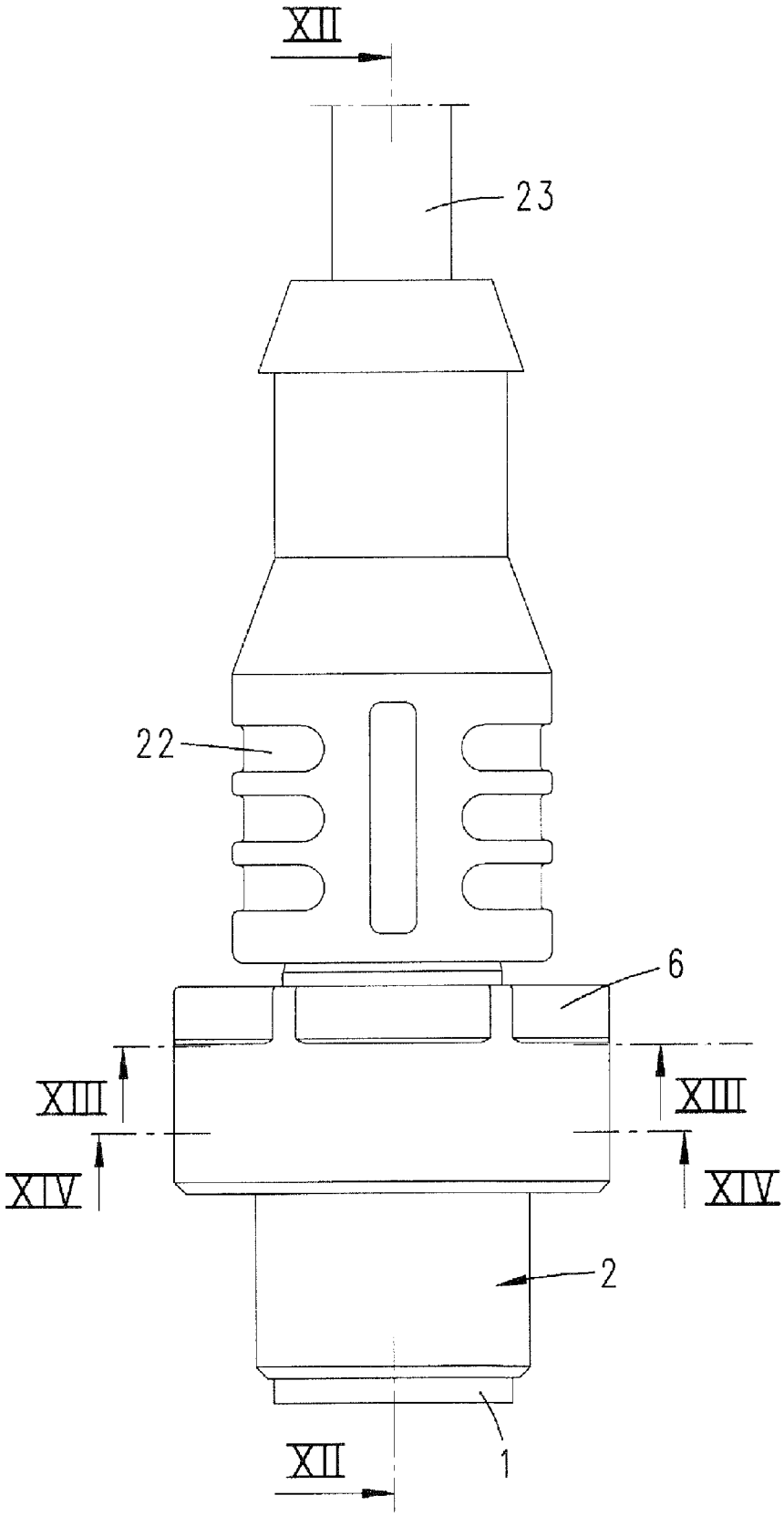
FIG. 11 shows a side view of a fourth exemplary embodiment.
Figure 12:
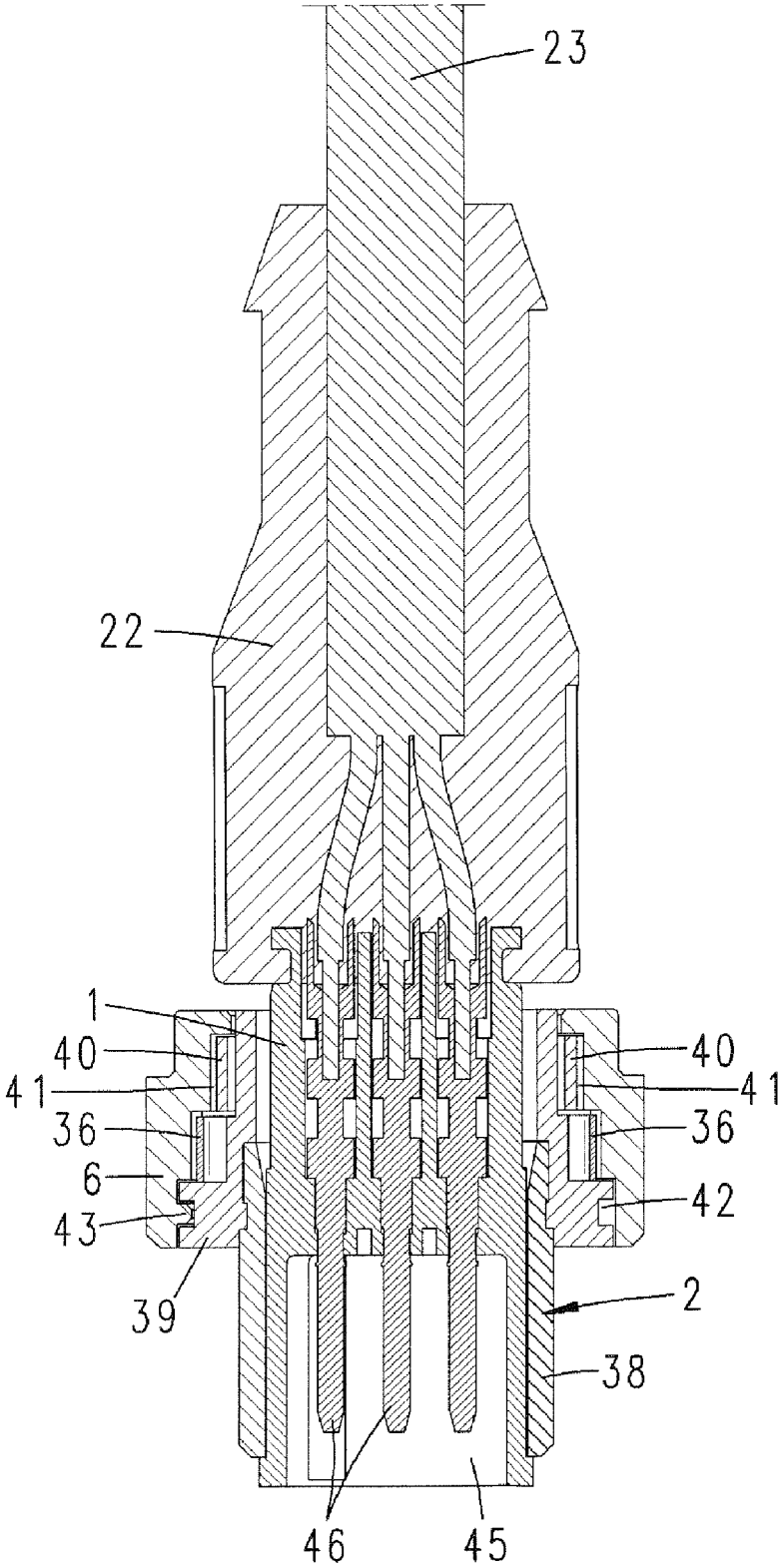
FIG. 12 shows a longitudinal cross section along line XII-XII of FIG. 11.
Figure 13:
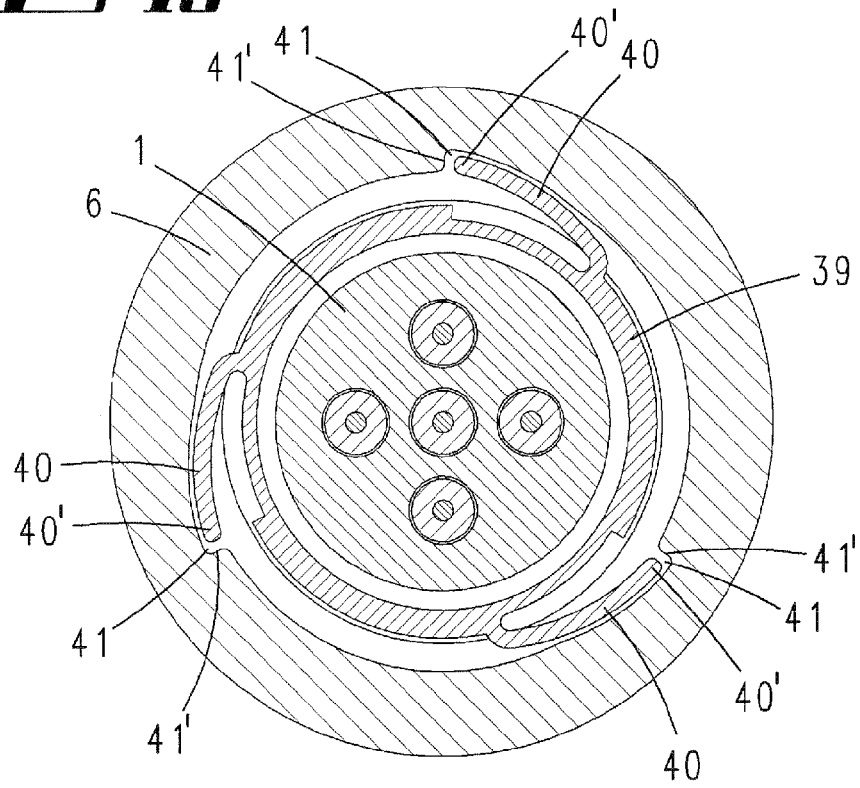
FIG. 13 shows a cross section along line XIII-XIII of FIG. 11.
Figure 14:
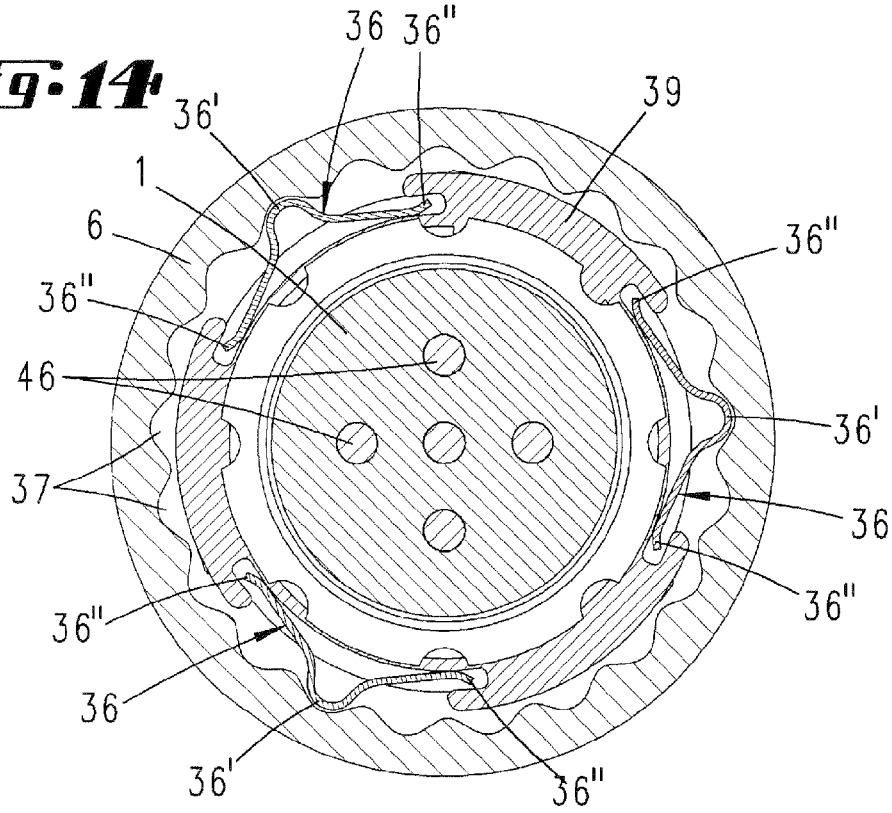
FIG. 14 shows a cross section along line XIV-XIV in FIG. 11.

In the case of third exemplary embodiment, shown only in part in FIGS. 9 and 10, the actuating sleeve 6 again turns the threaded part 2 along with it by way of driver lobes 26. These, however, now project in the axial direction from the threaded part 2 instead of in the radial direction from the threaded part 2. Here, too, the driver lobes 26 have sloping flanks 27 and steep flanks 28. In front of the sloping flank 17 of the driver lobe 26, there lies a sloping flank 32 of a driver element 31, which also has the form of a lobe and which is assigned to the actuating sleeve 6. The driver element 31 also has a steep flank 33. This steep flank 33 lies in front of the steep flank 28 of the driver lobe 26. The actuating sleeve 6 can be shifted axially against the restoring force of an elastic working element, designed here as a compression spring 34, wherein the driver elements 31 move out of the intermediate spaces between the driver lobes 26. This departure of the driver elements 31 from the intermediate spaces between the driver lobes 26 occurs when the torque to be transmitted from the actuating sleeve 6 to the threaded part 2 reaches a certain limit. This limit is reached, for example, when the mating threaded part 4 is exerting a certain force on the O-ring 5, which is also present here. The actuating sleeve 6 now moves in the axial direction against the restoring force of the compression spring 34 until the sloping flanks 27, 32 have slid past each other.

When the actuating sleeve 6 is turned in the opposite direction, that is, in the loosening direction of the screw connection, the steep flank 28 of the driver lobe 26 lies against the steep flank 33 of the driver element 31. The axial force is reduced, and this allows higher torques to be applied.

In the previously described exemplary embodiments, furthermore, vibration-proofing devices can also be provided to prevent the threaded part 2 from unintentionally coming loose from the mating threaded part. For example, FIG. 6 shows a geartooth-like design of the annular collar 11. An elastic web (not shown) or the like on the threaded part 2 or on the cap nut 6 can engage with this.

The fourth exemplary embodiment, shown in FIGS. 11-14, has a threaded part 2 with an external thread. The contact carrier 1 carries contact pins 46, which project into an insertion opening 45, into which a contact carrier of a corresponding mating plug part can be inserted. The mating plug part has a screw-in thread, into which the external thread of the threaded part 2 can be screwed. The contact carrier 1 is seated in an injection-molded plastic enclosure 22, which surrounds the connecting cable 23. The wires of the connecting cable 23 are connected in an electrically conductive manner to the contact pins 46.

The axial section of the contact carrier 1 which forms the insertion opening 45 is surrounded by a threaded sleeve 38. The threaded sleeve 38 consists of metal and has an external thread. The threaded sleeve 38 is connected to the sleeve piece 39 of plastic in a manner which prevents both rotation and axial movement. The sleeve piece 39 can be injection-molded onto the rear section of the threaded sleeve 38. The threaded sleeve 38 and the sleeve piece 39 can also be fabricated as a single part. It would thus be possible for part to be fabricated out of plastic as an injection-molded part or out of die-cast zinc. In the latter case, the locking springs 40 would have to be formed separately.

In a first axial plane, which is directly adjacent to the threaded sleeve 38, the sleeve piece 39 forms a groove 42, into which an extension 43 of an actuating sleeve 6, also consisting of plastic, engages. The actuating sleeve 6 is thus connected to the sleeve piece 39 so that it cannot move in the axial direction but is free to rotate.

In a second axial plane directly adjacent to the first, a total of three latching springs 36 is provided, which are distributed equally around the circumference. The latching springs 36 are formed by metal leaf springs, which have essentially the form of a "V". The ends 36" of the latching springs 36 lie in undercuts 44'. These undercuts 44' are formed by the edges of a bearing recess 44' in the sleeve piece 39. The ends 36" lie with a certain play in the undercuts 44'. In the middle, between the two ends 36", the latching springs 36 form a rounded spring crest 36'. This spring crest 36' projects radially beyond the lateral surface of the sleeve piece 39 to engage in a latching niche 37 in the actuating sleeve 6. In the area of the two axial planes, the actuating sleeve 6 forms a plurality of latching niches 37 on its inside wall in a wave-like arrangement, into which the total of three crests 36' of the latching springs 36 can engage.

A locking mechanism is arranged in a third axial plane, which is adjacent to the second axial plane. This locking mechanism 40, 41 is a type of ratchet mechanism, which offers a freewheel function in the tightening direction of the actuating sleeve 6 and a rotational driving function in the opposite direction. Spiral locking springs 40 project from the sleeve piece 39. The ends 40' of the locking springs 40 can engage in engagement niches 41 in the inside wall of the actuating sleeve 6. The engagement niches 41 are designed in such a way that the wall opposite the end 41' forms a locking shoulder 41'. The bottom of the engagement niche 41 otherwise merges smoothly with the inside wall of the actuating sleeve 6. When the actuating sleeve 6 is turned in the tightening direction, that is, in the counterclockwise direction in FIG. 13, the end 40' of the locking spring 40 moves away from the locking shoulder 41'. The locking springs 40 thus slide over the locking shoulders 41'. This corresponds to the freewheel direction of the ratchet mechanism. When the actuating sleeve 6 is turned in the opposite direction, that is, in the clockwise direction, the locking shoulders 41' come up against the ends 40' of the locking springs 40 engaging in the engagement niches 41, so that connection for rotation in common is established between the actuating sleeve 6 and the sleeve piece 39.

In the previously described third embodiment, the sleeve piece 39 can also be connected to a threaded sleeve 38 with an internal thread. This results in the following functional behavior: When the two plug parts of a plug connection are to be connected to each other, the actuating sleeve 6 is turned in the tightening direction of the thread. The thread of the plug part and the mating plug part engage with each other, because the threaded sleeve 38 is carried along as a result of the engagement of the latching springs 36 in the latching niches 37. The torque to be applied increases when the end surface of the contact carrier 1 comes up against a sealing ring, which is thus compressed. The sealing ring is compressed until the torque exceeds a certain limit. The limit torque is determined essentially by the spring stiffness and the shape of the latching spring 36. It is reached when all three latching springs 36 move out of the associated latching niches 37. Then the actuating sleeve 6 rotates relative to the sleeve piece 39, which is made possible by the freewheel function of the ratchet mechanism 40, 41.

To disconnect the screwed connection, torques higher than the limit torque can be applied. When this higher torque must be applied, it is true that the latching springs 36 first move out of the latching niches 37 assigned to them, so that initially the connection for rotation in common between the actuating sleeve 6 and the sleeve piece 39 is disengaged. But then the connection for rotation in common is restored as soon as the locking shoulders 41' come up against the ends 40' of the locking springs 40. Then, upon rotation of the actuating sleeve 6 in the loosening direction, the sleeve piece 39 and thus also the threaded part 38 connected nonrotatably to the sleeve piece 39 are carried along.

All of the features disclosed above are essential (in themselves) to the invention. The entire disclosure content of the associated/attached priority documents (copy of the preceding application) is herewith also included in the disclosure of the present application, this also being done for the purpose of incorporating features of these documents into the claims of the present application.

The invention claimed is:

1. An electric plug connector, comprising a contact carrier; a threaded part, which, in a design as a cap nut or cap screw, is threadable to a mating threaded part of a mating plug connector, wherein an elastic sealing element is compressed; an actuating sleeve, to which a torque can be applied, is connected to the threaded part for rotation in common; and an elastic working element, which, when the sealing element is compressed, is deformed so that the connection for rotation in common between the actuating sleeve and the threaded part is disengaged when a degree of that deformation exceeds a certain limit.

2. An electric plug connector according to claim 1, wherein the connection for rotation in common becomes disengaged when the degree to which the sealing element is compressed exceeds a predetermined value.

3. An electric plug connector according to claim 1, wherein the threaded part is displaceable both with respect to the contact carrier and with respect to the actuating sleeve against an elastic restoring force of the elastic working element in a direction toward the mating plug connector, wherein the connection for rotation in common with the actuating sleeve becomes disengaged when a displacement distance reaches a certain limit.

4. An electric plug connector according to claim 1, wherein the connection for rotation in common which is disengaged when the threaded part and the mating threaded part are screwed together, is restorable by an axial displacement of the actuating sleeve with respect to the threaded part.

5. An electric plug connector according to claim 1, wherein the connection for rotation in common is disengaged when the torque exceeds a certain limit.

6. An electric plug connector according to claim 1, wherein the actuating sleeve is spring-loaded in an axial direction against the threaded part.

7. An electric plug connector according to claim 6, wherein the actuating sleeve is spring-loaded by a wave washer.

8. An electric plug connector according to claim 1, wherein the working element is a compression spring element.

9. An electric plug connector according to claim 8, wherein the compression spring element is a wave washer.

10. An electric plug connector according to claim 8, wherein the compression spring element which spring-loads the actuating sleeve is supported on a shoulder of the contact carrier by way of a flat washer.

11. An electric plug connector according to claim 1, wherein the positive connection for rotation in common is formed by intermeshing sets of radial teeth on the actuating sleeve and on the threaded part.

12. An electric plug connector according to claim 11, wherein the sealing element is an 0-ring made of rubber, which is supported on an annular collar of the contact carrier, and at least certain areas of the threaded part have an internal thread and are surrounded by the actuating sleeve.

13. An electric plug connector according to claim 12, wherein the elastic working element is supported against a rear-facing surface of the annular collar.

14. An electric plug connector according to claim 12, wherein the threaded part has two pieces, wherein a first piece forms the set of radial teeth and is clipped onto a second piece forming the thread.

15. An electric plug connector according to claim 1, wherein the connection for rotation in common comprises latching springs, which, when in a rotational connection position, engage in latching niches so that torque can be transmitted, and move out of the latching niches when the torque exceeds a certain limit.

16. An electric plug connector according to claim 15, and further comprising a locking mechanism, designed as locking springs, for transmission of torques which are higher in a loosening direction of the screwed connection than the limit torque.

17. An electric plug connector according to claim 16, wherein the locking mechanism and the connection for rotation in common are arranged in different axial planes.

18. An electric plug connector according to claim 16, wherein the latching springs and/or the locking springs are assigned to the threaded part, and the latching niches and/or locking shoulders cooperating with the locking springs are assigned to the actuating sleeve.

19. An electric plug connector according to claim 15, wherein the latching springs are essentially V-shaped leaf springs, the leaf springs having ends that lie in retaining niches and round crests that lie, when in the rotationally connected position, in rounded latching niches.

20. An electric plug connector according to claim 16, wherein the locking springs are molded integrally out of a common material of a sleeve piece of the threaded part.

21. An electric plug connector according to claim 1, comprising sawtooth-like driver lobes, which form sloping flanks, against which driver elements, acted upon by the elastic working element, are supported and over which the driver elements slide when torque exceeds a certain limit.

22. An electric plug connector according to claim 21, wherein the driver elements are spring tongues formed out of the elastic working element.

23. An electric plug connector according to claim 22, wherein the spring tongues are formed by an annular spring element surrounded radially outwardly by the actuating sleeve and radially inwardly by the threaded part.

24. An electric plug connector according to claim 22, wherein the spring tongues cooperate with the driver lobes so that the spring tongues deflect in a radial direction.

25. An electric plug connector according to claim 23, wherein the driver lobes are assigned to the threaded part, and the annular spring element is connected nonrotatably to the actuating sleeve, and the actuating sleeve and the threaded part are assigned to the contact carrier in a manner which essentially prevents axial movement.

26. An electric plug connector according to claim 21, wherein the driver elements also comprise a sawtooth-like shape, wherein, under action of the elastic working element, sloping flanks of the driver elements rest against the sloping flanks of the driver lobes.

27. An electric plug connector according to claim 21, wherein the elastic working element is a compression spring element that spring-loads the actuating sleeve in the axial direction against the threaded part so as to axially displace the actuating sleeve relative to the threaded part until the degree of displacement reaches a certain limit, at which the driver elements and the driver lobes become disengaged from each other.

* * * * *